US007424811B2

(12) United States Patent
Ham et al.

(10) Patent No.: US 7,424,811 B2
(45) Date of Patent: Sep. 16, 2008

(54) HANDCUFFS FOR PREVENTING DOUBLE-LOCKING

(75) Inventors: Sang-Sik Ham, Anyang (KR); Do-Hun Ham, Anyang (KR); Ju-Taek Park, Incheon (KR)

(73) Assignee: MR Infraauto Co., Ltd., Incheon (KR)

( * ) Notice: Subject to any disclaimer, the term of this patent is extended or adjusted under 35 U.S.C. 154(b) by 0 days.

(21) Appl. No.: 12/004,466

(22) Filed: Dec. 20, 2007

(65) Prior Publication Data

US 2008/0148788 A1 Jun. 26, 2008

(51) Int. Cl.
*E05B 75/00* (2006.01)

(52) U.S. Cl. ..... 70/16

(58) Field of Classification Search ..... 70/15–19; 119/816, 819; 128/878, 879
See application file for complete search history.

(56) References Cited

U.S. PATENT DOCUMENTS

| | | | | | |
|---|---|---|---|---|---|
| 268,171 | A * | 11/1882 | Bean | 70/16 |
| 1,456,846 | A * | 5/1923 | Gamwell | 70/16 |
| 1,579,333 | A * | 4/1926 | Neal | 70/16 |
| 1,775,727 | A * | 9/1930 | Latou | 70/16 |
| 2,759,349 | A * | 8/1956 | McKee | 70/16 |
| 4,314,466 | A * | 2/1982 | Harris | 70/16 |
| 5,138,852 | A * | 8/1992 | Corcoran | 70/16 |
| 5,660,064 | A * | 8/1997 | Ecker et al. | 70/16 |
| 5,743,117 | A * | 4/1998 | Woo et al. | 70/16 |
| 6,672,116 | B1 * | 1/2004 | Hilliard | 70/16 |
| 7,251,964 | B2 * | 8/2007 | Wade | 70/16 |
| 7,316,137 | B2 * | 1/2008 | Parsons | 70/16 |
| 2007/0163308 | A1 * | 7/2007 | Piane | 70/16 |

* cited by examiner

*Primary Examiner*—Lloyd A Gall
(74) *Attorney, Agent, or Firm*—Weingarten, Schurgin, Gagnebin & Lebovici LLP

(57) ABSTRACT

To handcuffs for preventing double-locking is added a structure or a member in which a stopper is in resilient contact with and is locked to bodies of the stationary hoops, so that the movement of the stopper is basically prevented even if shocks are transmitted from sides of the bodies of the stationary hoops while the handcuffs are carried, and thus the ability to move a detent thereof is secured. Thereby, a swivel hoop can be rapidly rotated under emergency circumstances while the handcuffs are carried, and can be meshed with the ratchet of a detent installed between the bodies of the stationary hoops. To this end, each of the handcuffs includes a pair of semi-circular stationary hoops on one side thereof, a semi-circular swivel hoop on the other side thereof, a detent and a stopper, which are interposed between the bodies of the stationary hoops, a spring, which resiliently holds the detent and the stopper against each other, a double-locking preventing unit, which causes the stopper to be locked on and be in resilient contact with the bodies of the stationary hoops, and a unit that moves the stopper in one direction by forcibly releasing the double-locking preventing unit.

9 Claims, 9 Drawing Sheets

HANDCUFFS FOR PREVENTING DOUBLE-LOCKING

This application claims priority to a REPUBLIC OF KOREA application No. 10-2006-0133553 filed Dec. 26, 2006.

BACKGROUND OF THE INVENTION

1. Field of the Invention

The present invention relates to handcuffs for preventing double-locking, and more particularly to handcuffs for preventing double-locking, in which a stopper is prevented from being displaced by shocks while handcuffs are carried, and thus a detent, which is meshed with the ratchet of a swivel hoop, is not locked, thereby allowing the swivel hoop to be rapidly pivoted and locked under emergency circumstances.

2. Description of the Prior Art

In general, such handcuffs are locked around the wrists of a suspect or a person to be taken into custody, and are used to restrict free action as well as to prevent self-injury and escape. A variety of paired handcuffs have been proposed, each side of which comprises two halves, one half of which is coupled by a swivel hoop, so as to be locked around the wrists, and include a key for unlocking the same.

Most of the handcuffs include a pair of semi-circular stationary hoops, which are integrally formed to have rectangular bodies and are separated from each other by a predetermined interval by means of a spacing member on one side of each handcuff, a semi-circular swivel hoop, which is coupled to ends of the stationary hoops so as to pivot about a pivot pin and is provided with a ratchet having a plurality of teeth on an outer surface thereof on the other side of each handcuff, a detent and a stopper, which are interposed between the bodies of the stationary hoops, have a travel passage along which the swivel hoop can travel, and function to lock and unlock the swivel hoop, and a spring, which resiliently holds the detent and the stopper against each other.

The conventional handcuffs constructed in this way are carried in the state in which the ratchet of the swivel hoop is meshed with the ratchet of the detent installed between the bodies of the stationary hoops so as to be rotated in one direction, and are used to perform a locking operation under emergency circumstances in such a manner that the swivel hoop is quickly rotated by a half turn about one end of the stationary hoops, and then the ratchet of the swivel hoop is again meshed with the ratchet of the detent installed between the bodies of the stationary hoops.

In other words, while the handcuffs are carried, the stopper, installed between the bodies of the stationary hoops, is moved by an external shock, thus preventing the detent from moving and the swivel hoop from locking. Such prevention of the swivel hoop from being locked on the detent is referred to as double-locking prevention.

However, most of the conventional handcuffs, including those disclosed in Korean Patent No. 10-0539171 and Korean Utility Model Registration Nos. 20-0216208, 20-0344023, and 20-0377082, include a stopper formed of a leaf spring so as to be movable left and right in a spacing member, and a bent end of the stopper is weakly locked on the locking step of a detent. Hence, when a shock is transmitted from the side of the bodies of the stationary hoops, the bent end of the stopper rides over the locking step of the detent, and thus the support piece of the stopper supports the free end of the detent. This causes a problem in which the detent is fixed, thus locking the ratchet of the swivel hoop, i.e. the double-locking operation occurs.

Further, the handcuffs disclosed in U.S. Pat. No. 5,660,064 are designed such that the locking step of a stopper is locked on the locking step of a detent on one side thereof, and such that a cap installed resiliently by a spring is locked in an arcuate recess of the bottom surface of the stopper on the other side thereof. However, as soon as a shock is applied from the side of the stationary hoops, the stopper is forced to move while pressing the cap. This movement causes the support piece of the stopper to support the top surface of the free end of the detent. This also results in a problem in which the detent is fixed, thus locking the ratchet of the swivel hoop, i.e. in that the double-locking operation occurs.

SUMMARY OF THE INVENTION

Accordingly, the present invention has been made keeping in mind the above problems occurring in the prior art, and an object of the present invention is to provide handcuffs for preventing double-locking, to which a structure or a member is included or added such that a stopper is in resilient contact with and is locked on bodies of stationary hoops, so that the movement of the stopper is basically prevented even if a shock is transmitted from the sides of the bodies of the stationary hoops while the handcuffs are carried, and thus the movement of the detent is secured. Thereby, a swivel hoop can be rapidly rotated under emergency circumstances while the handcuffs are carried, and can be meshed with the ratchet of a detent installed between the bodies of the stationary hoops.

In order to achieve the above object, according to the present invention, provided are handcuffs for preventing double-locking, each of which includes: a pair of first and second semi-circular stationary hoops that are integrally formed with rectangular bodies and are separated from each other by a predetermined interval by means of a spacing member on one side of each handcuff; a semi-circular swivel hoop that is coupled to ends of the first and second stationary hoops so as to pivot about a pivot pin, and is provided with a ratchet having a plurality of teeth on an outer surface thereof on the other side of each handcuff; a detent and a stopper which are interposed between the bodies of the first and second stationary hoops, have a travel passage along which the swivel hoop can travel, and function to lock and unlock the swivel hoop; a spring that resiliently holds the detent and the stopper against each other; means for preventing double-locking, which causes the stopper to be locked to the bodies of the first and second stationary hoops while the stopper is in resilient contact with the bodies of the first and second stationary hoops; and means for moving the stopper in one direction by forcibly releasing the double-locking preventing means.

In the handcuffs according to the present invention, the double-locking preventing means may include a counterbore-like hole formed in the stopper; a resilient member installed in the large diameter portion of the counterbore-like hole 53 and pushing the stopper to be in contact with the body of the first stationary hoop; and a locking knob formed on the body of the first stationary hoop and inserted into and locked in the counterbore-like hole of the stopper so as to prevent the stopper from moving freely. The locking knob may be made of the same material as the body of the first stationary hoop by means of pressing, or may be constructed such that a pin hole is drilled into the body of the first stationary hoop, and a locking pin is inserted into the pin hole.

In the handcuffs according to the present invention, the double-locking preventing means may include a locking knob and a hole for placing a resilient member, which is formed in the stopper, the resilient member, which is installed in the hole for placing the resilient member so as to push the stopper to contact the body of the first stationary hoop; and a hole for holding the locking knob, which is formed such that the locking knob of the stopper is inserted into and locked on the body of the first stationary hoop so as to prevent the stopper from being moved.

Further, the stopper may include a second resilient member covered by a cap near the resilient member so as to be doubly locked on opposite surfaces thereof, and the body of the second stationary hoop may be provided with a spherical locking recess into which the cap is inserted at the position where the body of the second stationary hoop is in contact with the cap of the second resilient member.

In the handcuffs according to the present invention, the stopper moving means may include a recess that is formed at one end of the stopper to allow a cylindrical pin of a key for unlocking the handcuffs to be inserted thereinto, and a rectangular guide slot, which is formed in the body of the first stationary hoop above the recess so as to allow a support piece of the stopper to support the top surface of a free end of the detent when the stopper is moved. The guide slot may be longer than required to receive the locking knob of the stopper.

In the handcuffs according to the present invention, the stopper moving means may include a tapered face, which is formed at one end of the stopper so as to press a resilient member, and a plunger, which is installed in the spacing member between the bodies so as to push and advance the tapered face of the stopper in one direction.

In the handcuffs according to the present invention, when the body of the first stationary hoop is provided with a hole for holding the locking knob or a guide slot, and when the stopper is provided with a counterbore-like hole, the counterbore-like hole may have a pushpin therein such that a pin of the pushpin extends from the large diameter portion to the small diameter portion of the counterbore-like hole, and the large diameter portion of the counterbore-like hole may have a resilient member therein.

In the handcuffs according to the present invention, the stopper moving means, serving simultaneously as the double-locking preventing means, may include a long guide slot, which is formed in the body of the first stationary hoop, a rectangular recess, which is formed in the surface of the stopper that corresponds to the guide slot in the lengthwise direction of the stopper, and a leaf spring, which is installed in the rectangular recess and includes a resilient piece, an end of which is locked on one end of the guide slot, and a movement restricting ridge, which protrudes from the resilient piece and restricts the movement of the stopper when pressed to move the stopper.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1A:
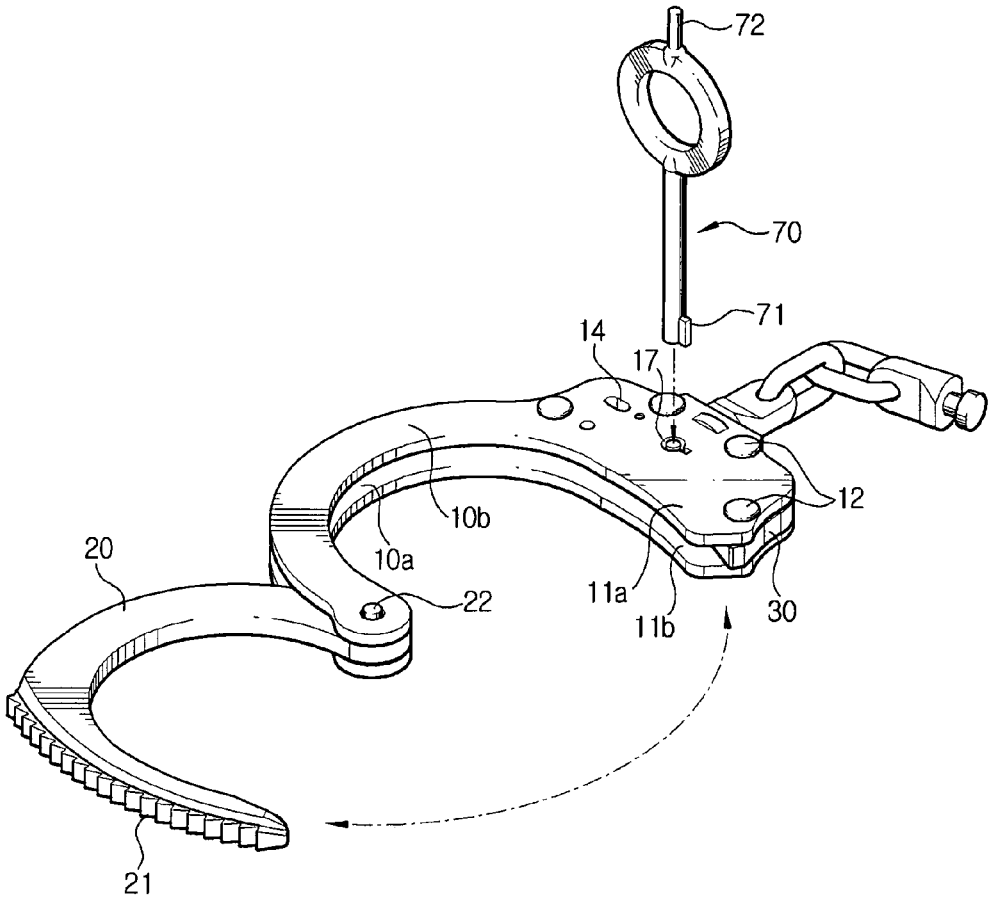
FIGS. 1A and 1B are perspective view illustrating handcuffs for preventing double-locking according to the present invention.

Reference will now be made in greater detail to handcuffs for preventing double-locking according to an exemplary embodiment of the invention, which is illustrated in the accompanying drawings. Wherever possible, the same reference numerals will be used throughout the drawings and the description to refer to the same or like parts.

Figure 1B:
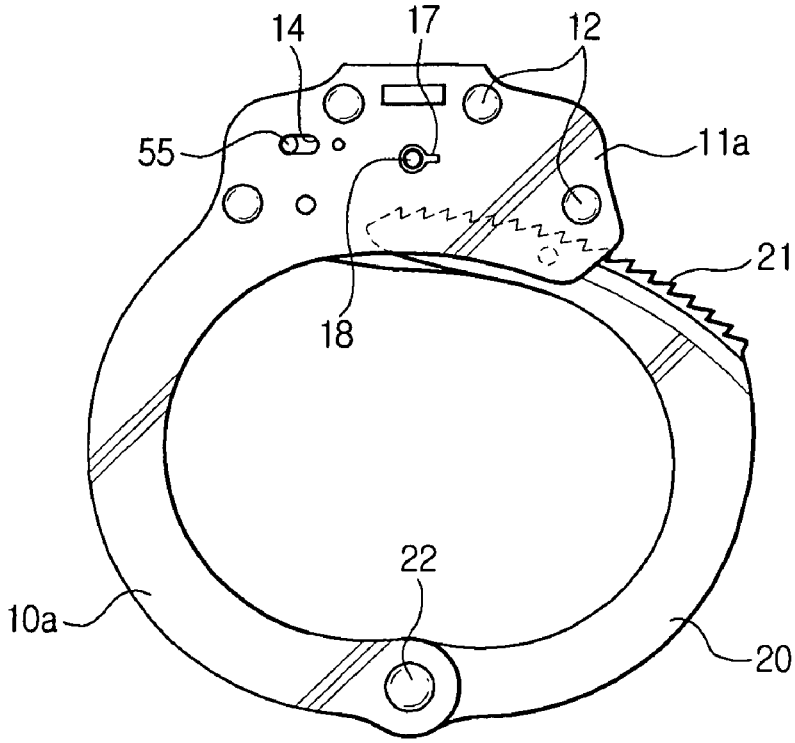
Figure 2:
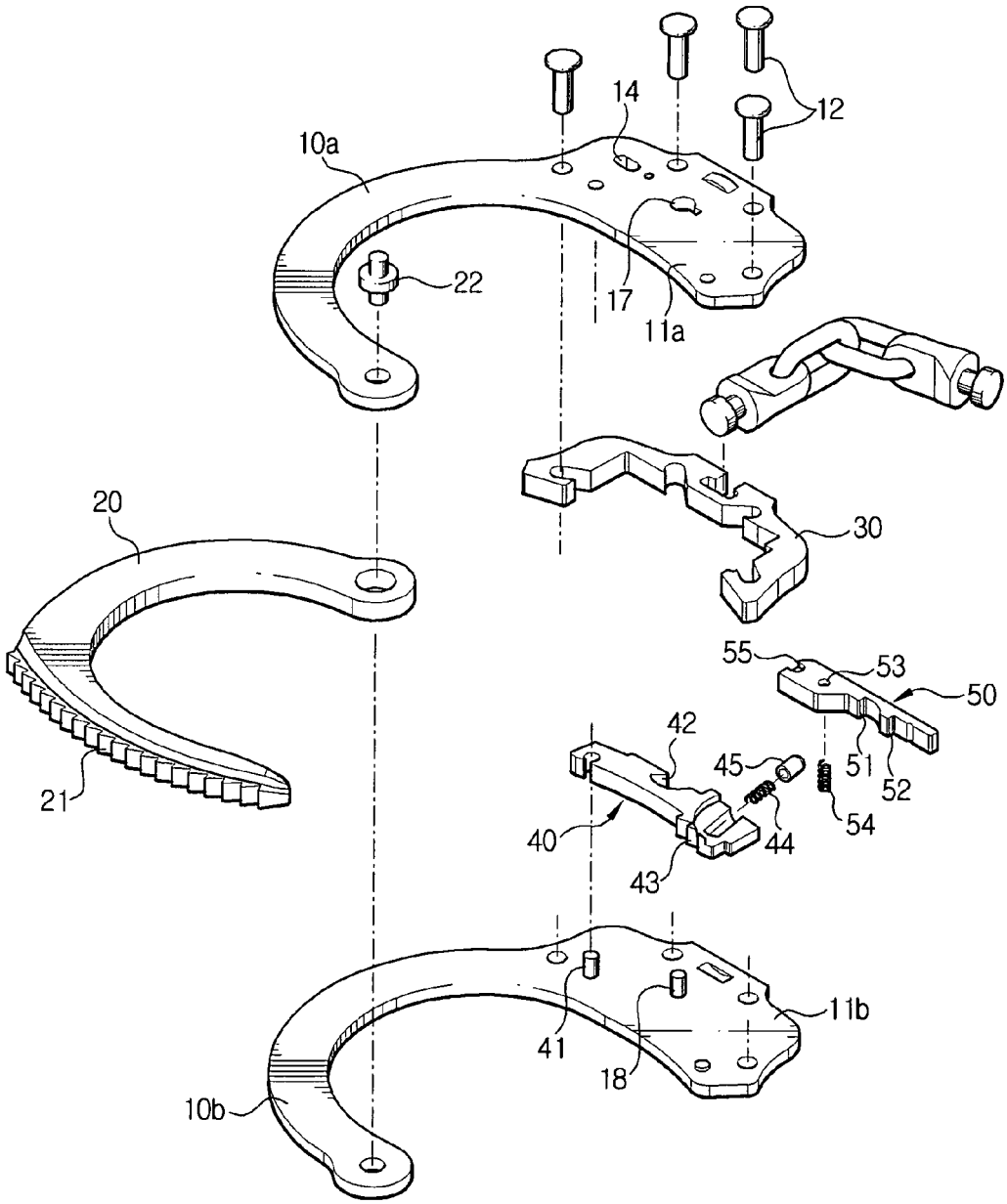
FIG. 2 is an exploded perspective view of FIGS. 1A and 1B.
Figure 3:
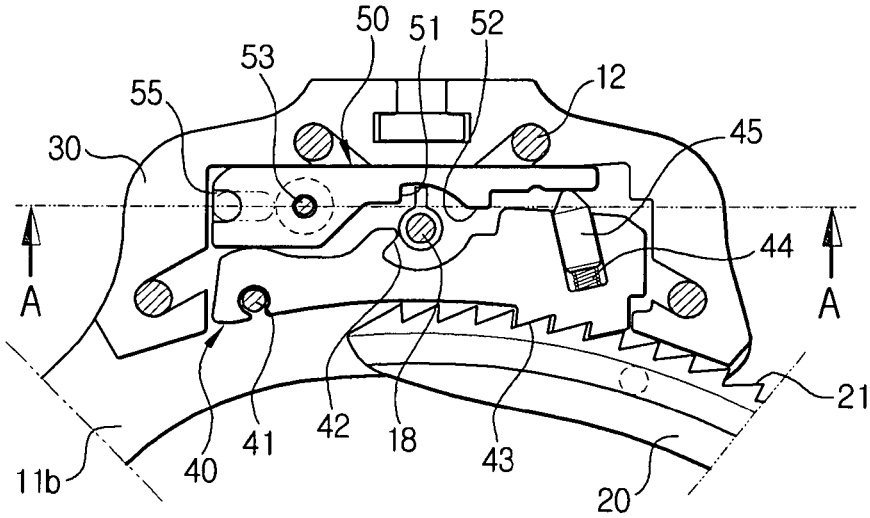
FIG. 3 is a front view showing a means for preventing double-locking and a means for moving a stopper in the handcuffs for preventing double-locking according to an embodiment of the present invention.
Figure 4:
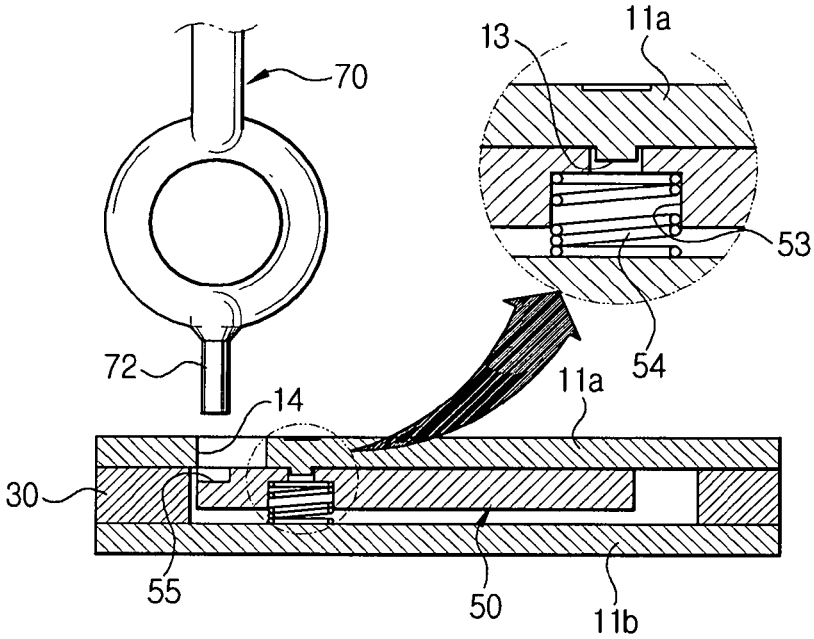
FIG. 4 is a detailed sectional view taken along line A-A of FIG. 3.

FIG. 1 is a perspective view illustrating handcuffs for preventing double-locking according to the present invention. FIG. 2 is an exploded perspective view of FIG. 1. FIG. 3 is a front view showing a means for preventing double-locking and a means for moving a stopper in the handcuffs for preventing double-locking according to an embodiment of the present invention. FIG. 4 is a detailed sectional view taken along line A-A of FIG. 3.

As illustrated in the figures, each of the inventive handcuffs includes a pair of semi-circular stationary hoops 10*a* and 10*b* on one side thereof, and a semi-circular swivel hoop 20 on the other side thereof, wherein the stationary hoops 10*a* and 10*b* are integrally formed with rectangular bodies 11*a* and 11*b* and are separated from each other by a predetermined interval by means of a spacing member 30, and the swivel hoop 20 is coupled to one end of each of the stationary hoops 10*a* and 10*b* so as to pivot about a pivot pin 22, and is provided with a ratchet 21 having a plurality of teeth on an outer surface thereof.

The stationary hoops 10*a* and 10*b* are fixed by a plurality of rivets 12 together with the spacing member 30 interposed between the bodies 11*a* and 11*b*, so that an inner space of the spacing member 30 is provided with a travel passage along which the swivel hoop 20 can travel, as well as a detent 40 and a stopper 50, which function to lock and unlock the swivel hoop 20.

The detent 40 pivots about a hinge 41 at one end thereof in the inner space of the spacing member 30, and is provided with a release piece 42 on the top surface thereof so as to be locked on the bit 71 of a key 70 for unlocking the handcuffs. The detent 40 is provided with a ratchet 43 on the bottom surface of the other end, the free end, thereof so as to be prevented from escaping from the inner space of the spacing member 30.

The stopper 50 is installed so as to move left and right between the inner top surface of the spacing member 30 and the detent 40, and is provided on the bottom surface thereof with a locking step 51 and a support piece 52, which protrudes so that it is in contact with the top surface of the free end of the detent 40. The free end of the detent 40 is provided with a spring 44 so that it is elastically biased against the stopper 50. The spring 44 is covered with a cap 45 so that it is in smooth contact with the stopper 50.

In order to prevent the handcuffs from being double-locked due to external shocks while the handcuffs are carried, the bodies 11*a* and 11*b* of the stationary hoops 10*a* and 10*b*, the spacing member 30 between the bodies 11*a* and 11*b*, and the stopper 50 and the detent 40 installed in the spacing member 30 are combined to provide a means for preventing double-locking, which causes the stopper 50 to be locked to the bodies 11*a* and 11*b* while the stopper 50 is in resilient contact with the bodies 11*a* and 11*b*, as well as a means for moving the stopper 50 in one direction by forcibly releasing the double-locking preventing means.

The double-locking preventing means is constructed such that the stopper 50 is provided with a counterbore-like hole 53, such that a resilient member 54 is installed in a large diameter portion of the counterbore-like hole 53 and pushes the stopper 50 so that it is in contact with the body 11*a* of the stationary hoop 10*a*, and such that the body 11*a* of the stationary hoop 10*a* is provided with a locking knob 13 that is inserted into and locked in the counterbore-like hole 53 of the stopper 50 so as to prevent the stopper 50 from moving freely.

The locking knob 13 is the same material as the body 11*a*, and integrally protrudes from the body 11*a*. However, the locking knob 13 may be embodied as a separate pin that is inserted into and fixed in the body 11*a*.

The stopper moving means is constructed such that one end of the stopper 50 is provided with a recess 55 into which a cylindrical pin 72 of the key 70 for unlocking the handcuffs can be inserted, and such that the body 11*a* above the recess 55 is provided with a rectangular guide slot 14 so as to allow the support piece 52 of the stopper 50 to support the free end of the detent 40 when the stopper 50 is moved.

The interval between the bodies 11*a* and 11*b*, which are separated from each other by means of the spacing member 30, is 1 mm greater than the thickness of the stopper 50, and the height of the locking knob 13 formed at the body 11*a* is in the range from 0.5 mm to 0.6 mm. Hence, when it is intended to double-lock each handcuff by intentionally moving the stopper 50, the recess 55 of the stopper 50 is pushed down through the guide slot 14. Thereby, the stopper 50 deviates further from the locking knob 13 of the body 11*a*, in the range from 0.4 mm to 0.5 mm, so that the stopper 50 can be moved toward the free end of the detent 40.

Among the reference numbers which have not yet been described, 17 indicates a hole into which the bit of the key for unlocking each handcuff is inserted in the middle of the body 11*a*, 18 indicates a pin on which the bit of the key for unlocking each handcuff is placed in the middle of the body 11*b*, 70 indicates the key for unlocking each handcuff, 71 indicates the bit formed at one end of the key for unlocking each handcuff, and 72 indicates the cylindrical pin formed at the other end of the key for unlocking each handcuff.

As mentioned above, each of the double-locking preventing handcuffs is constructed such that, when the swivel hoop 20 coupled to the ends of the stationary hoops 10*a* and 10*b* through the pivot pin 22 is rotated to enter the inner space of the spacing member 30 between the bodies 11*a* and 11*b* in contact with the spacing member 30, the ratchet 43, formed at the free end of the detent 40, resiliently held against the stopper 50 by the spring 44, is meshed with the ratchet 21 on the outer surface of the swivel hoop 20. At this time, because the stopper 50 is moved in one direction, the support piece 52 of the end of the stopper 50 does not support the top surface of the free end of the detent 40, and thus the detent 40 is allowed to pivot outwards.

Because the ratchets 43 and 21 of the detent 40 and the swivel hoop 20 are toothed (in one direction), the swivel hoop 20 is inserted when pushed in the counterclockwise direction in the figures. However, because the ratchet 21 of the swivel hoop 20 is locked on the ratchet 43 of the detent when it is pulled in the clockwise direction, the swivel hoop 20 cannot be released in the clockwise direction.

The inventive handcuffs are carried in this state. While the handcuffs are carried, shocks can be transmitted from the sides of the bodies 11*a* and 11*b*, or the bodies 11*a* and 11*b* can collide with other objects in the process of locking the handcuffs. At this time, as in FIG. 5A, the stopper 50 is in resilient contact with the body 11*a* by means of the resilient member 54, and the locking knob 13 of the body 11*a* is locked by insertion into the small diameter portion of the counterbore-like hole 53 of the stopper 50. Hence, the stopper 50 is not allowed to move to the left and right sides of the spacing member 30.

Thus, as mentioned above, in the inventive handcuffs, the stopper 50 can be basically prevented from being moved by the shocks transmitted from the sides of the bodies 11*a* and 11*b*, and thus the ability to move the detent 40 is secured, so that they can be quickly locked by rotating the swivel hoop 20 in the counterclockwise direction in an emergency while the handcuffs are carried, by allowing the ratchet 21 of the outer surface of the swivel hoop 20 to mesh with the ratchet 43 of the detent 40 installed in the bodies 11*a* and 11*b* of the stationary hoops 10*a* and 10*b*.

After being locked as mentioned above, the handcuffs should be double-locked so as to prevent the detent 40 from moving, which will be described with reference to FIGS. 5A, 5B and 5C.

Figure 5A:
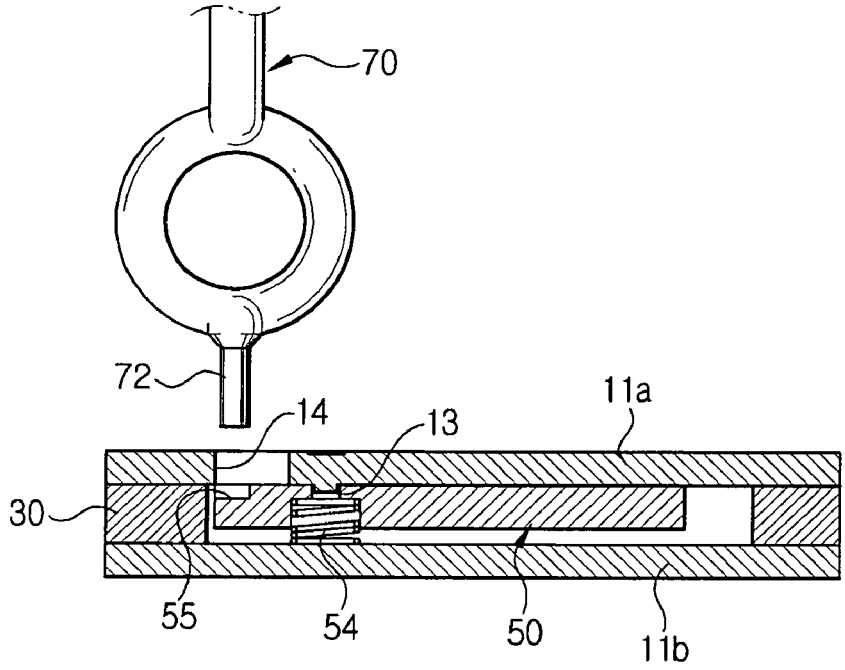
FIGS. 5A, 5B and 5C are sectional views for explaining a process of moving a stopper, to which a means for preventing double-locking according to the prevent invention is applied.
Figure 5B:
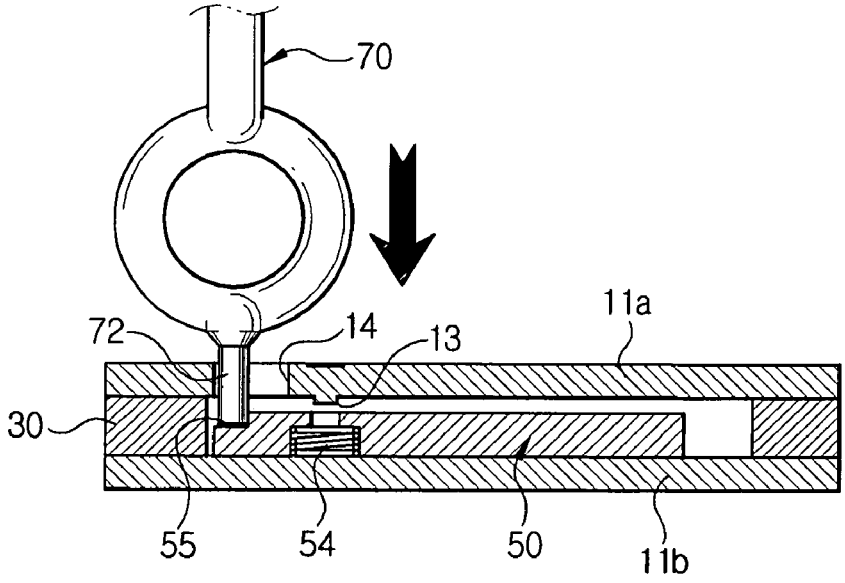

First, in FIG. 5A, as described above, the stopper 50 is in resilient contact with the body 11*a* by means of the resilient member 54, and the locking knob 13 of the body 11*a* is kept locked because it is inserted into the small diameter portion of the counterbore-like hole 53 of the stopper 50.

In this state, the cylindrical pin 72 of the key 70 for unlocking the handcuffs is inserted into the recess 55 of the stopper 50 through the guide slot 14 of the body 11*a* with a predetermined force, and thus the stopper 50 is pressed against, and contacts, the body 11*b* beneath it. Thereby, as in FIG. 5B, the locking knob 13 of the body 11*a* above the stopper 50 is unlocked by escaping from the small diameter portion of the counterbore-like hole 53 of the stopper 50.

More specifically, the interval between the bodies 11*a* and 11*b*, which are separated from each other by means of the spacing member 30, is about 1 mm greater than the thickness of the stopper 50, and the height of the locking knob 13, formed in the body 11*a*, is in the range from about 0.5 mm to about 0.6 mm. Hence, when the recess 55 of the stopper 50 is pressed down through the guide slot 14, the stopper 50 additionally deviates and escapes from the locking knob 13 of the body 11*a* within a range from about 0.4 mm to about 0.5 mm.

Figure 5C:
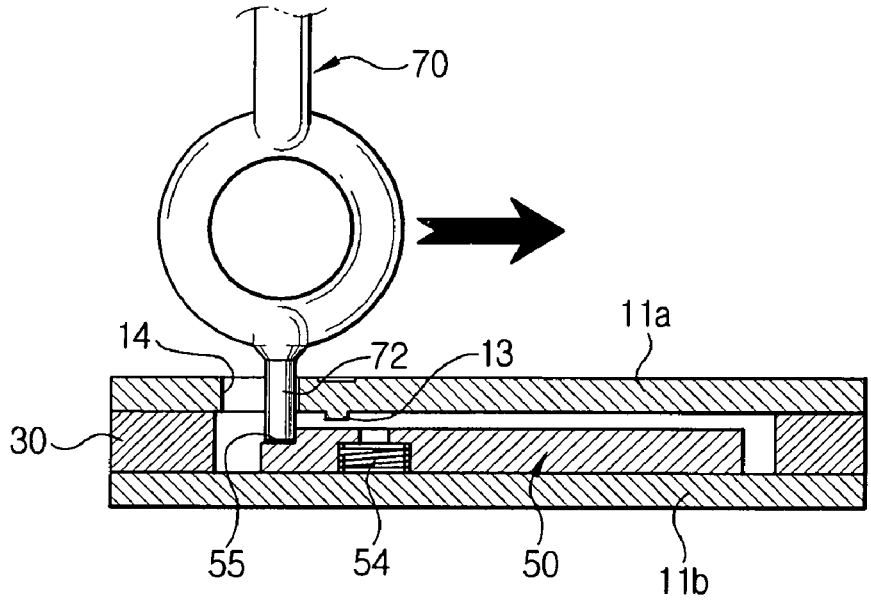

In this state, as in FIG. 5C, when the cylindrical pin 72 of the key 70 for unlocking the handcuffs is pushed to the right side, the stopper 50 is also moved to the right side. Thereby, the support piece 52 of the bottom surface of the stopper 50 is in contact with the top surface of the free end of the detent 40, and thus the detent 40 is prevented from being moved. Therefore, the double-locked state, in which the swivel hoop 20 cannot be rotated in the counterclockwise direction or in the clockwise direction, is obtained.

When it is desired to unlock the handcuffs double-locked in this way, the bit 71 of the key 70 for unlocking the handcuffs is inserted into and placed on the pin 18 of the body 11*b* which is used for placing the key, the key 70 for unlocking the handcuffs is rotated at an angle of about 120° in the counterclockwise direction, and thereby pushes the locking step 51 of the bottom surface of the stopper 50, thus moving the stopper 50 to the left side, so that the support piece 52 of the bottom surface of the stopper 50 deviates from the top surface of the free end of the detent 40. As a result, the double-locked state is released. At this time, the detent 40 is resiliently supported by the stopper 50 and the spring 44, but it is allowed to slightly pivot about the hinge 41 at one side thereof in the counterclockwise direction.

When the key 72 for unlocking the handcuffs is rotated at an angle from about 220° to about 240° in the clockwise direction in the state in which the double-locked state is released as described above, the bit 71 of the key 72 for unlocking the handcuffs lifts the release piece 42 of the top surface of the detent 40, and thereby the ratchet 21 of the swivel hoop 20, which is locked on and meshed with the ratchet 43 of the detent 40, is released from the ratchet 43 of the detent 40. As a result, the swivel hoop 20 is rotated in the clockwise direction, and thereby the restriction of the swivel hoop 20 is released from the bodies 11*a* and 11*b* of the stationary hoops 10*a* and 10*b*.

Figure 6:
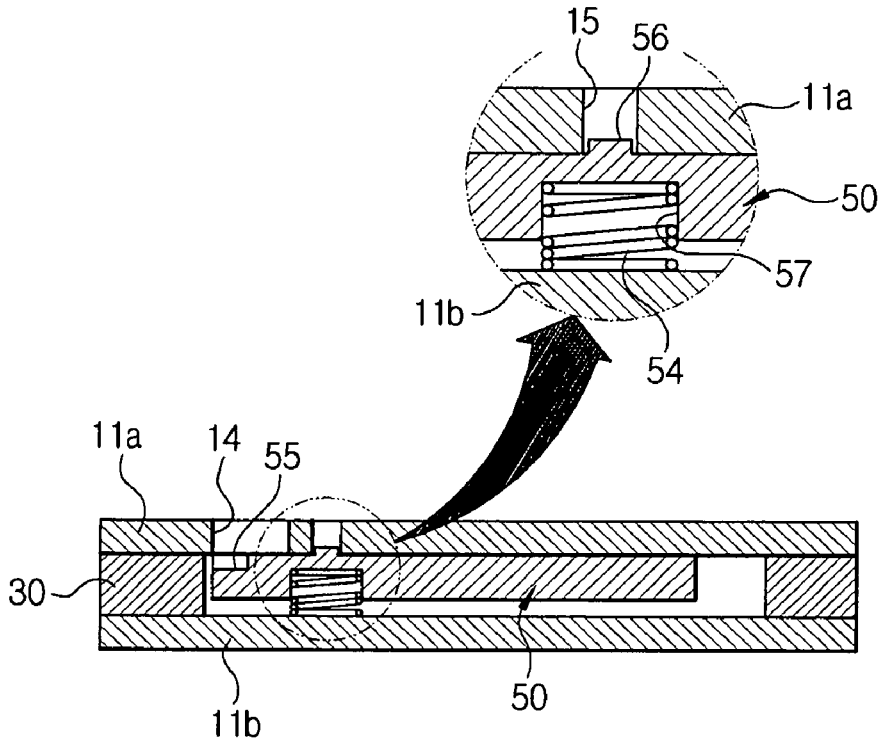
FIGS. 6 through 10 are sectional views illustrating other embodiments showing a means for preventing double-locking and a means for moving a stopper in the handcuffs of the present invention.

FIG. 6 is a sectional view illustrating another embodiment showing a double-locking preventing means of the handcuffs of the present invention. Here, the stopper 50 is concentrically provided with a locking knob 56 and a hole 57 in which the resilient member is placed. The resilient member 54 is inserted into the hole 57 to position the resilient member so that it pushes the stopper 50, which is in contact with the body 11*a* of the stationary hoop 10*a*. The body 11*a* of the stationary hoop 10*a* is provided with a hole 15 for holding and locking the locking knob 56 of the stopper 50 so as to prevent the stopper 50 from being moved.

Figure 7:
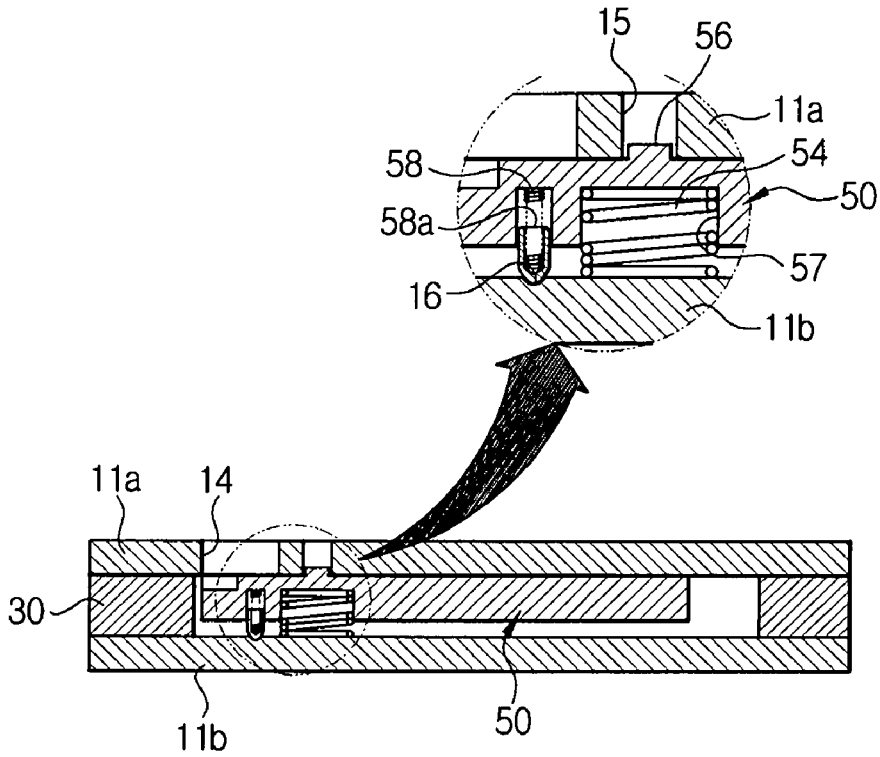

FIG. 7 is a sectional view illustrating yet another embodiment showing a double-locking preventing means of the handcuffs of the present invention. Here, in addition to the double-locking preventing means of FIG. 6, the stopper 50 is provided with a second resilient member 58 covered by a cap 58*a* near the resilient member 54 so as to be doubly locked on opposite surfaces thereof. The body 11*b* is provided with a spherical locking recess 16 into which the cap 58*a* is inserted at the position where the body 11*b* is in contact with the cap 58*a* of the second resilient member 58.

As described above, the operation of the double-locking preventing means constructed according to the other embodiments of FIGS. 6 and 7 is the same as that according to one embodiment, and so the detailed description thereof will be omitted.

Figure 8:
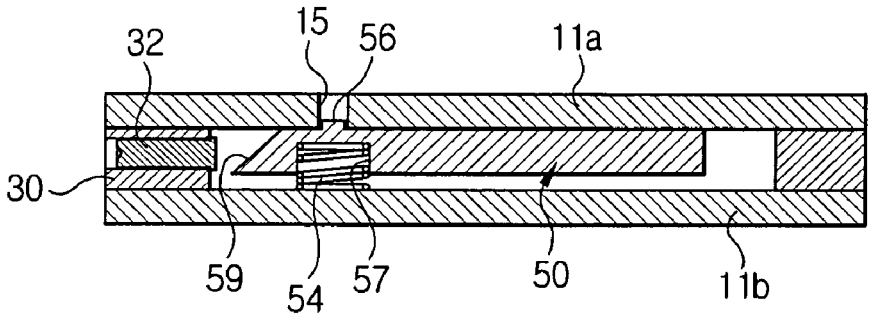

FIG. 8 is a sectional view illustrating another embodiment showing a stopper moving means of the handcuffs of the present invention. Here, the stopper moving means includes a tapered face 59 that is formed at one end of the stopper 50 so as to press the resilient member 54, and a plunger 32 that is installed in the spacing member 30 between the bodies 11*a* and 11*b* so as to push and advance the tapered face 59 of the stopper 50 in one direction.

According to the other embodiment constructed in this way, when the stopper 50 is intended to be double-locked, the plunger 32, installed movably in the spacing member 30, is pushed by the cylindrical pin 72 of the key 70 for unlocking the handcuffs, so that the plunger 32 is pressed by the tapered face 59 of one end of the stopper 50, and is in contact with the body 11*b* below the stopper 50, and thus the locking knob 56 of the stopper 50 escapes and is released from the hole 15 for holding the locking knob. Then, the plunger is continuously pushed, and thus the stopper 50 is moved toward the free end of the detent 40.

Figure 9:
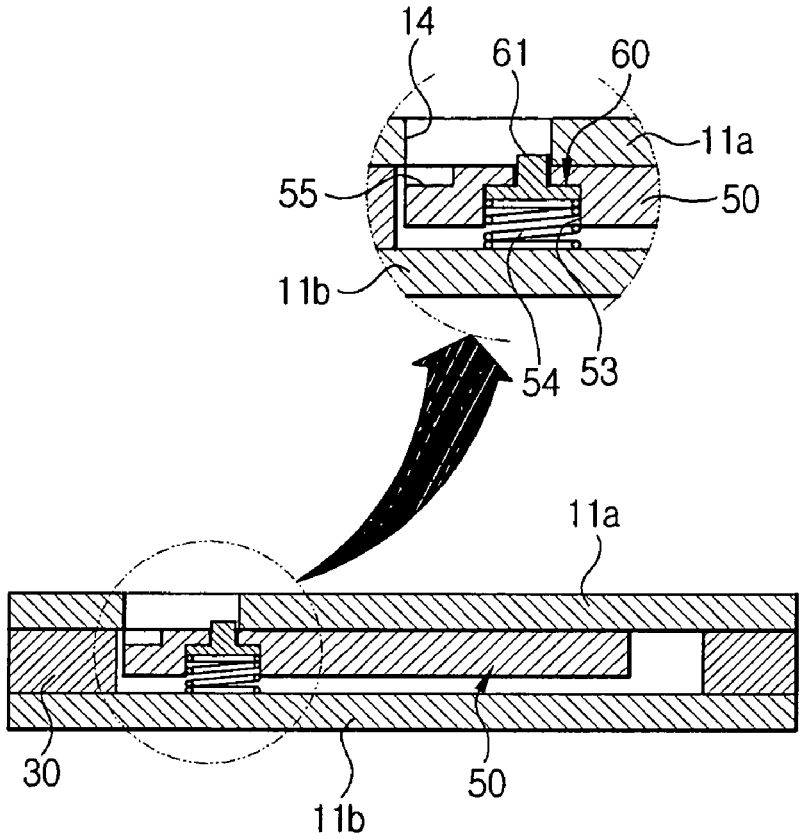

FIG. 9 is a sectional view illustrating yet another embodiment showing a stopper moving means, which serves simultaneously as a double-locking preventing means in the handcuffs of the present invention. Here, the body 11*a* is provided with a hole 15 for holding the locking knob or a guide slot 14. When the stopper 50 is provided with a counterbore-like hole 53, a pushpin 60 is installed in the counterbore-like hole 53 such that a pin 61 thereof protrudes from the large diameter portion to the small diameter portion of the counterbore-like hole 53. A resilient member 54 is installed in the large diameter portion of the counterbore-like hole 53 so as to push the stopper 50 so that it is in contact with the body 11*a*.

The guide slot 14 of the body 11*a* may be formed at a length capable of holding the locking knob 56 of the stopper 50, i.e. up to the position of the hole 15 for holding the locking knob.

As described above, the operation of the double-locking preventing means and the stopper moving means constructed according to the other embodiment is the same as that according to the first embodiment, and so a detailed description thereof will be omitted.

Figure 10:
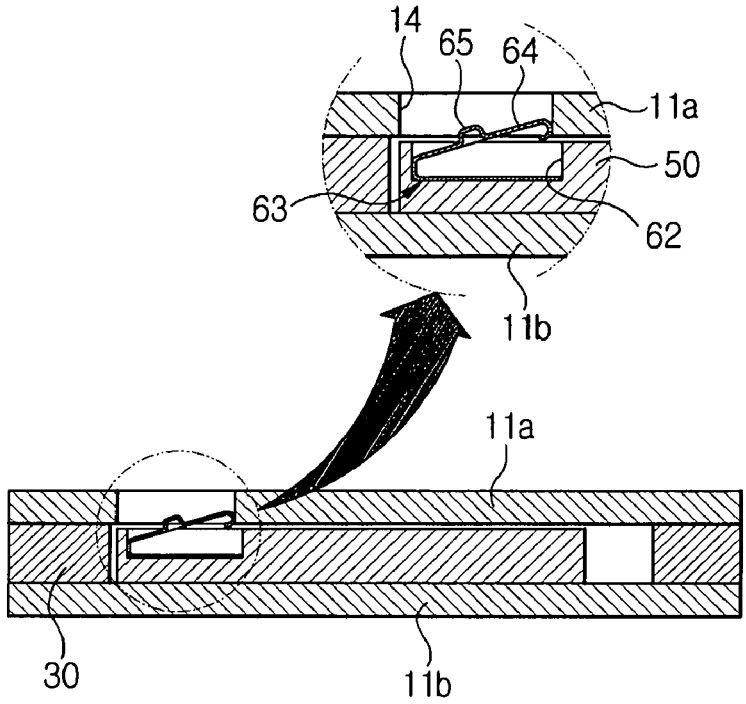

FIG. 10 is a sectional view illustrating yet another embodiment showing a stopper moving means, serving simultaneously as a double-locking preventing means, of the handcuffs of the present invention. Here, the stopper 50 is provided with a long rectangular recess 62 in one surface thereof in the lengthwise direction thereof so as to be in contact with and correspond to the guide slot 14 of the body 11*a*, and a leaf spring 63 is installed in the rectangular recess 62. The leaf spring 63 includes a resilient piece 64, one end of which is locked in one end of the guide slot 14, and a movement restricting ridge 65, which protrudes from the resilient piece 64 and restricts the movement of the stopper 50 when pressed to move the stopper 50.

According to the other embodiment as described above, because the end of the leaf spring 63 installed in the rectangular recess 62 of the stopper 50 is locked in the guide slot 14 of the body 11*a*, the stopper 50 is basically prevented from being moved toward the free end of the detent 40 even if shocks are transmitted to the sides of the bodies 11*a* and 11*b*, so that double-locking is prevented. When double-locking is intentionally performed, the resilient piece 64 of the leaf spring 63 is pressed to push the stopper 50 toward the free end of the detent 40 using the cylindrical pin 72 of the key 70 for unlocking the handcuffs such that it is moved without obstruction until the movement restricting ridge 65 of the stopper 50 arrives at the end of the guide slot 14.

As described in detail above, according to the handcuffs for preventing double-locking, a structure or a member in which the stopper is in resilient contact with and is locked to the bodies of the stationary hoops is provided or added to thus form the double-locking preventing means and the stopper moving means, so that the movement of the stopper is basically prevented even if shocks are transmitted from the sides of the bodies of the stationary hoops while the handcuffs are carried, and thus the ability to move the detent is secured. As a result, the swivel hoop can be quickly rotated in an emergency while the handcuffs are carried, and can be meshed with the ratchet of the detent installed between the bodies of the stationary hoops.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. Handcuffs for preventing double-locking, each comprising:

a pair of first and second semi-circular stationary hoops that are integrally formed with generally rectangular bodies and are separated from each other by a predetermined interval by means of a spacing member on one side of each handcuff;

a semi-circular swivel hoop that is coupled to ends of the first and second stationary hoops so as to pivot about a pivot pin, and is provided with a ratchet having a plurality of teeth on an outer surface thereof on the other side of each handcuff;

a detent and a stopper, which are interposed between the bodies of the first and second stationary hoops, have a travel passage along which the swivel hoop can travel, and function to lock and unlock the swivel hoop;

a spring that resiliently holds the detent and the stopper against each other;

means for preventing double-locking, which causes the stopper to be locked to the bodies of the first and second stationary hoops while the stopper is in resilient contact with the bodies of the first and second stationary hoops; and means for moving the stopper in one direction by forcibly releasing the double-locking preventing means.

2. The handcuffs as claimed in claim 1, wherein the double-locking preventing means includes a counterbore-like hole formed in the stopper; a resilient member installed in the large diameter portion of the counterbore-like hole and pushing the stopper so that it is in contact with the body of the first stationary hoop; and a locking knob formed on the body of the first stationary hoop and inserted into and locked in the counterbore-like hole of the stopper so as to prevent the stopper from moving freely.

3. The handcuffs as claimed in claim 1, wherein the double-locking preventing means includes a locking knob and a hole for placing a resilient member which is formed in the stopper, the resilient member, which is installed in the hole for placing the resilient member so as to push the stopper to contact the body of the first stationary hoop; and a hole for holding the locking knob, which is formed such that the locking knob of the stopper is inserted into and locked in the body of the first stationary hoop so as to prevent the stopper from being moved.

4. The handcuffs as claimed in claim 3, wherein: the stopper includes a second resilient member covered by a cap near the resilient member so as to be doubly locked on opposite surfaces thereof; and the body of the second stationary hoop is provided with a spherical locking recess, into which the cap is inserted at a position where the body of the second stationary hoop is in contact with the cap of the second resilient member.

5. The handcuffs as claimed in claim 1, wherein the stopper moving means includes a recess that is formed at one end of the stopper to allow a cylindrical pin of a key for unlocking the handcuffs to be inserted thereinto, and a rectangular guide slot that is formed on the body of the first stationary hoop above the recess so as to allow a support piece of the stopper to support a top surface of a free end of the detent when the stopper is moved.

6. The handcuffs as claimed in claim 5, wherein the guide slot is longer than required to receive a locking knob of the stopper.

7. The handcuffs as claimed in claim 1, wherein the stopper moving means includes a tapered face that is formed at one end of the stopper so as to press a resilient member, and a plunger that is installed in the spacing member between the bodies so as to push and advance the tapered face of the stopper in one direction.

8. The handcuffs as claimed in claim 6, wherein, the stopper is provided with a counterbore-like hole, the counterbore-like hole has a pushpin therein such that a pin of the pushpin extends from a large diameter portion to a small diameter portion of the counterbore-like hole, and the large diameter portion of the counterbore-like hole has a resilient member therein.

9. The handcuffs as claimed in claim 1, wherein the stopper moving means, which serves simultaneously as the double-locking preventing means, includes a long guide slot, which is formed in the body of the first stationary hoop, a rectangular recess, which is formed in one surface of the stopper, which corresponds to the guide slot in a lengthwise direction of the stopper, and a leaf spring, which is installed in the rectangular recess and includes a resilient piece, one end of which is locked into one end of the guide slot, and a movement restricting ridge, which protrudes from the resilient piece and restricts movement of the stopper when pressed to move the stopper.

* * * * *

UNITED STATES PATENT AND TRADEMARK OFFICE

CERTIFICATE OF CORRECTION

PATENT NO. : 7,424,811 B2
APPLICATION NO. : 12/004466
DATED : September 16, 2008
INVENTOR(S) : Sang-Sik Ham et al.

It is certified that error appears in the above-identified patent and that said Letters Patent is hereby corrected as shown below:

Title page, item [30] insert the following:

--Foreign Application Priority Data
December 26, 2006 Republic of Korea.....10-2006-0133553--; and Title page, item (73) Assignee, "Infraauto" should read --InfraAuto--.

Signed and Sealed this

Second Day of June, 2009

JOHN DOLL
*Acting Director of the United States Patent and Trademark Office*